United States Patent [19]

Wolf

[11] 4,300,620

[45] Nov. 17, 1981

[54] METHOD OF MONITORING THE MOLD GEOMETRY DURING THE CONTINUOUS CASTING OF METALS, ESPECIALLY STEEL

[75] Inventor: Manfred Wolf, Zürich, Switzerland

[73] Assignee: Concast AG, Zürich, Switzerland

[21] Appl. No.: 187,573

[22] Filed: Sep. 15, 1980

[30] Foreign Application Priority Data

Oct. 2, 1979 [CH] Switzerland ..... 8873/79

[51] Int. Cl.[3] ..... B22D 11/00; B22D 11/16

[52] U.S. Cl. ..... 164/452; 164/459

[58] Field of Search ..... 164/4, 154, 82

[56] References Cited

U.S. PATENT DOCUMENTS 3,886,991 6/1975 Meier et al. ..... 164/4

OTHER PUBLICATIONS

"Heat Transfer and Skin Formation in a Continuous Casting Mold as a Function of Steel Carbon Content", by Singh et al., Journal of Metal, p. 17, Oct. 1974.

"Betriebserfahrungen mit dünnwandigen nahtlosen Stranggusskokillen", Stahl und Eisen, p. 111, 1968.

*Primary Examiner*—Robert D. Baldwin

*Assistant Examiner*—K. Y. Lin

*Attorney, Agent, or Firm*—Werner W. Kleeman

[57] ABSTRACT

A method of monitoring the mold geometry during the continuous casting of billets and blooms formed of steel. During the progress of the continuous casting operation there is measured the actual value of the withdrawal of heat at the continuous casting mold and this value is compared with a set or reference value. In the presence of a deviation exceeding a predetermined magnitude there is determined a damaging mold geometry.

5 Claims, 1 Drawing Figure

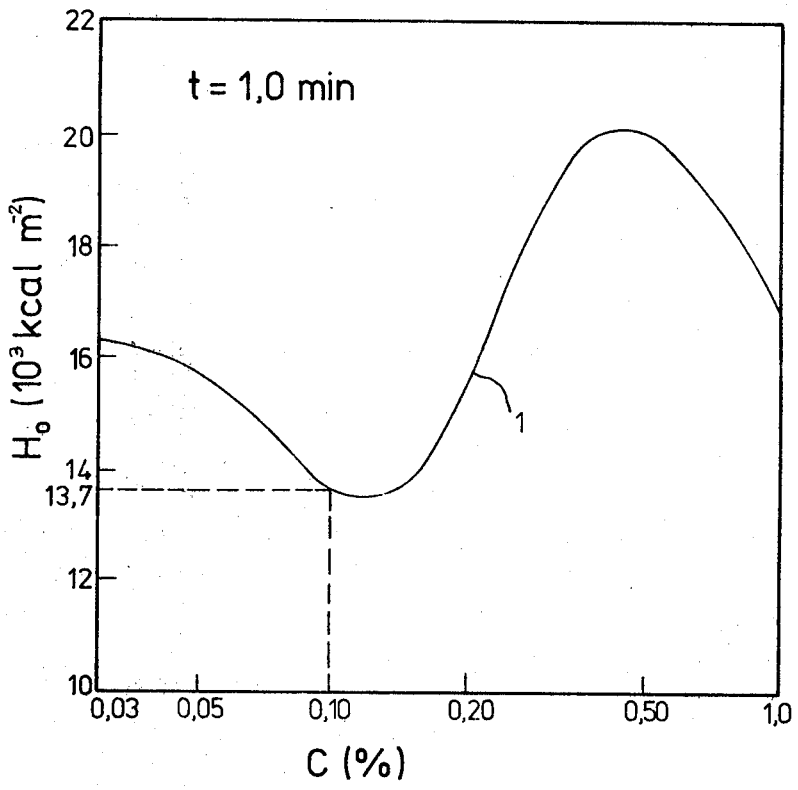
t = 1,0 min
22
20
18
16
14
13,7
12
10
$H_o$ ($10^3$ kcal $m^{-2}$)
1
0,03
0,05
0,10
0,20
0,50
1,0
C (%)

METHOD OF MONITORING THE MOLD GEOMETRY DURING THE CONTINUOUS CASTING OF METALS, ESPECIALLY STEEL

BACKGROUND OF THE INVENTION

The present invention relates to a new and improved method of monitoring the mold geometry during the continuous casting of steel billets and blooms.

It is already known to the art to increase the withdrawal of heat by conically tapering at all sides the hollow mold compartment in the lengthwise direction of the cast strand at continuous casting molds for the continuous casting of billets and blooms. In this way it is also possible to favorably affect the growth of the strand shell or skin. There are different teachings as to the manner in which there is to be accommodated the taper to the strand contraction, in order to obtain the positive effect as concerns the heat removal and the strand skin growth without there being present too great mold friction. However, a once optimized mold geometry changes during the course of the use of the mold due to wear and/or distortion in such a manner that, for instance, there is eliminated the predetermined mold taper or, in fact, there arises a converse taper. When there prevails inadequate geometry of the mold then there can arise damage to the cast strand, for instance, fissures or metal break-out.

It is equally known to the art that the carbon content of unalloyed steels tends to extremely variably influence the heat withdrawal and the mold friction. Thus, the carbon content is also taken into account during optimizing the mold taper.

In order to avoid damage it is therefore conventional practice in this art to check the mold geometry from time-to-time by means of a suitable gauge or the like when the mold is not in use. However, for this purpose there must be undertaken complicated and time-consuming measurements with the aid of micrometers or electronic gauges or the like at the continuous casting mold during such time as the same is not in use, i.e. during pauses between the casting operations.

SUMMARY OF THE INVENTION

Therefore, with the foregoing in mind it is a primary object of the present invention to provide an improved method of monitoring in a most accurate and reliable manner the geometry of a continuous casting mold in a manner not associated with the aforementioned drawbacks and limitations of the prior art.

It is another important object of the present invention to provide a method of monitoring the geometry of a mold by means of which it is possible to check with extremely simple means during the progression of the continuous casting operation the mold geometry, in order to be able to detect early enough undesired changes at the mold and to avoid economically disadvantageous strand damage or impairment, such as for instance fissures or metal break-out.

Now in order to implement these and still further objects of the invention which will become more readily apparent as the description proceeds, the method of the invention contemplates that, during the progress of the continuous casting operation the actual value of the heat withdrawn at the continuous casting mold is determined and compared with a reference value which is predetermined as a function of the carbon content and the residence time of the cast steel in the mold. Upon deviation of the actual value from this reference value by a predetermined amount there is ascertained a damaging change of the geometry of the mold.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE illustrates a graph along the ordinate of which there is plotted the heat quantity and along the abscissa there is plotted in a logarithmic scale the carbon content for the most interesting range of unalloyed steels and serving to explain the invention.

DETAILED DESCRIPTION OF THE PREFERRED EMBODIMENTS

In practicing the invention, the heat withdrawn at the continuous casting mold is determined, for instance, by means of the thermal energy which is taken-up by the cooling water and compared with a reference or set value. This reference value is dependent upon the carbon content of the steel which is to be cast and the residence time of the cast strand in the mold. The value or magnitude of the deviation which is indicative of a damaging change in the geometry of the mold is dependent upon both the casting conditions, especially the casting velocity and the casting temperature, but also upon the quality requirements of the end product, such as, for instance, rhomboidness, edge lengthwise fissures and transverse fissures. If there is present a deviation of the measured value for the heat removal from the reference value which exceeds the predetermined value, then such deviation constitutes an indication of an insufficient mold geometry, and that there must be carried out further measures for ensuring for an appropriate strand quality. Thus, there is possible a continuous control or checking possibility of the condition of the strand within the mold which is in the process of being continuously cast. Hence, there can be detected early enough and prevented strand damage possibly arising because of inadequate mold geometry.

The permissible deviation of the actual value from the predetermined reference value, depending upon experience, advantageously amounts to about between 15 percent and 30 percent of the reference or set value. This depends, within this range, upon parameters, such as casting velocity or speed or the requirements which are placed upon the strand quality.

Advantageously, with only a slightly larger deviation than corresponding to the above-mentioned tolerable value of 15 percent to 30 percent, the mold is measured-out after completion of the pour which is in progress and, if necessary, exchanged. Whether and when such exchange of the mold occurs depends upon internal quality criteria, which vary from plant to plant. In any event, there is no longer required any time-consuming measuring-out of the mold after each pour or teeming operation and the attained saving in time is associated with economical advantages.

It is advantageous to lower the casting velocity or to interrupt the pouring or teeming operation when there prevail appreciably greater deviations of the actual value from the reference value of the withdrawn quantity of heat than corresponding to the above-indicated value or magnitude of 15 to 30 percent. By carrying out these immediate corrective measures, based upon the determined insufficient mold geometry, there is avoided damage to the strand and, in the event of metal break-out, also damage to the casting installation due to the immediate corrective actions which can be undertaken at the casting plant and rendered possible by the invention.

The method of the invention will be explained more fully hereinafter in conjunction with an example while referring to the single FIGURE of the accompanying drawing.

Along the ordinate of this single drawing FIGURE there has been plotted the heat quantity $H_o$ (in $10^3$ kcal·m$^{-2}$), and along the abscissa there has been plotted, on a logarithmic scale, the carbon content for the most interesting range of unalloyed steels containing between 0.03 and 1.0 percent by weight carbon. The curve designated by reference character 1 represents reference values for the quantity of heat which is to be withdrawn as a function of the carbon content of the cast steels. This curve is valid for a residence time of the cast strand or a strand element within the mold amounting to about 1 minute. The residence time (in minutes) is defined by dividing the effective mold length (in meters) by the casting velocity (in m·min$^{-1}$). The effective mold length is constituted by the spacing or distance between the bath level or mensicus of the strand forming in the mold and the exit end of the mold. This curve 1 furthermore is valid for billets and small bloom sectional shapes which are cast with oil lubrication in the mold. For an unalloyed carbon steel having a content of 0.10 percent by weight carbon the reference value for the quantity of heat which is to be withdrawn, according to curve 1, is at approximately $13.7 \cdot 10^3$ kcal·m$^{-2}$. With a tolerable deviation of ±20% of this value, as the predetermined magnitude,—which corresponds approximately to intermediate quality requirements for the steel which is to be cast—an adequate mold geometry is then present when the withdrawn quantity of heat is between 11.0 to $16.4 \cdot 10^3$ kcal·m$^{-2}$.

Now if there is present a slightly greater deviation then corresponding to such mentioned boundaries, for instance, if the withdrawn quantity of heat amounts to $10.8 \cdot 10^3$ kcal·m$^{-2}$, then such constitutes an indication that there is present a disturbed, damaging mold geometry, and the mold, following completion of the pour or teeming operation which is in progress, is measured. If the measured value is, for instance, however appreciably lower than the above-mentioned, tolerable lower boundary or limit of $11.0 \cdot 10^3$ kcal−m$^{-2}$, for instance is at $10.0 \cdot 10^3$·kcal·m$^{-2}$, then such is evaluated as an indication of a markedly damaged mold geometry and, since there must be feared metal break-out, the pour or teeming operation which is in progress must be interrupted.

With different actual residence times of a strand element in the mold, which can arise with different mold lengths or different casting velocities, the mold geometry, with the exemplary assumed tolerated deviation of ±20 percent then must still be considered as satisfactory if the measured value $H_x$ lies in the range of the relationship:

$$0.8 \cdot H_o \cdot t^{0.5} \leqq H_x \leqq 1.2 \cdot H_o \cdot t^{0.5}.$$

In the foregoing equation $H_x$ constitutes the determined value of the withdrawn quantity of heat in the mold (in $10^3$ kcal·m$^{-2}$), $H_o$ represents the reference value for the quantity of heat (in $10^3$ kcal·m$^{-2}$) which is to be withdrawn, depending upon the carbon content of the cast steel, and reference character t represents the actual residence time of a strand element in the mold (in minutes), and this residence time is obtained by dividing the effective mold length (in meters) by the casting velocity (in m·min$^{-1}$).

The determination of the quantity of heat which is to be withdrawn can be accomplished by measuring the temperature increase of the influxing and effluxing cooling water for the mold. The comparison of this quantity of heat with the corresponding reference values can be accomplished manually by means of a predetermined graph or diagram or also can be carried out by using a comparator with an electronic system. With impermissible deviation there can be produced an optical or acoustical warning signal. Depending upon the intensity of this signal it is then possible to undertake the different corrective measures as explained above.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method for monitoring the geometry of a mold during the continuous casting of steel strands, for instance billets and blooms, and replacing a detected damaged mold, comprising the steps of:

during the continuous casting operation determining an actual value of the withdrawal of heat from the continuous casting mold;

comparing such actual value with a predetermined reference value which is set as a function of the carbon content of the cast steel and the residence time of the cast steel within the mold;

upon deviation of the actual value from such reference value by a predetermined amount determining a damaging change in the geometry of the continuous casting mold; and exchanging the continuous casting mold when the determined damaging change requires utilization of a different continuous casting mold for further casting operations.

2. The method as defined in claim 1, further including the steps of:

evaluating as a permissible deviation a deviation of the actual value from the reference value in the order of 15 to 30 percent.

3. The method as defined in claim 2, further including the steps of:

after completion of a pouring of the steel which is in progress measuring the continuous casting mold when there is encountered an only slightly greater deviation than said 15 to 30 percent to determine if the damage is of a magnitude sufficient to warrant mold exchange.

4. The method as defined in claim 2, further including the steps of:

upon encountering an appreciably greater deviation than said 15 to 30 percent reducing the casting velocity.

5. The method as defined in claim 2, further including the steps of:

upon encountering an appreciably greater deviation than said 15 to 30 percent interrupting the casing operation.

* * * * *